US006694638B1

(12) United States Patent
Krioukov et al.

(10) Patent No.: US 6,694,638 B1
(45) Date of Patent: Feb. 24, 2004

(54) DRYER VENT CHECK STRIP

(76) Inventors: Oleg Krioukov, 31946 Pacific Coast Hwy., Malibu, CA (US) 90265; Zoya Krioukova, 31946 Pacific Coast Hwy., Malibu, CA (US) 90265

( * ) Notice: Subject to any disclaimer, the term of this patent is extended or adjusted under 35 U.S.C. 154(b) by 0 days.

(21) Appl. No.: 10/436,751

(22) Filed: May 12, 2003

(51) Int. Cl.[7] ..... F26B 19/00

(52) U.S. Cl. ..... 34/89; 34/497; 34/89; 34/108; 34/595

(58) Field of Search ..... 34/89, 88, 497, 34/498, 499, 443, 108, 595

(56) References Cited

U.S. PATENT DOCUMENTS 5,860,224 A * 1/1999 Larson ..... 34/418

* cited by examiner

*Primary Examiner*—Henry Bennett
*Assistant Examiner*—Camtu Nguyen
(74) *Attorney, Agent, or Firm*—Thomas I. Rozsa; Tony D. Chen

(57) ABSTRACT

A vent check strip for checking a dryer or a vent pipe connected to a dryer. The vent check strip has a temperature sensitive area that changes its color at a threshold temperature within a working temperature range of the dryer when the dryer functions normally. The vent check strip can be placed inside the dryer or the vent pipe so that after the dryer is turned on to perform its normal drying function for a period of time until the dryer reaches the working temperature range, the vent check strip can be retrieved for examination. If the vent check strip does not change its color, then it indicates that the dryer is malfunction or the vent pipe is clogged, kinked, broken or otherwise damaged and needs to be serviced.

7 Claims, 1 Drawing Sheet

DRYER VENT CHECK STRIP

BACKGROUND OF THE INVENTION

1. Field of the Invention

The present invention generally relates to the field of tools and devices used for maintenance and repair services of residential and commercial dryers. More particularly, the present invention relates to the field of tools and devices used for quickly and easily determining the source of malfunction of residential and commercial dryers.

2. Description of the Prior Art

A typical problem causing malfunction of residential and commercial dryers is the clogging of the hot air vent pipe or hose connected to the dryer. Ordinarily the vent pipe provides an exhaust conduit for the hot air and moisture generated from the dryer when the dryer is operating. However, lint, small items (such as women's stocking) and other debris from the dryer operation often accumulate inside the vent pipe which causes the vent pipe to be clogged. In addition, kinked pipe or hose also block the exhaustion of the hot air and moisture from the dryer. As a result, the performance efficiency of the dryer may be significantly reduced. In worst cases, the dryer will malfunction and the clogged vent pipe or conduit will become a fire hazard.

When a dryer becomes less efficient or malfunction, the user often calls for maintenance or repair service which can be very expensive. Often times the service personnel is not sure whether the problem is from the dryer itself or from other sources such as the vent pipe or conduit connected to the dryer, and has to make a laborious effort to find out exactly what is wrong. Unfortunately many standard warranties that come with the new dryers only cover services performed directly on the dryers and do not cover the services for checking up the vent systems. In such event the consumer user has to pay for the services for checking up the vent systems which can be quite expensive.

It is therefore desirable to have a new testing device which can provide a quick and easy check-up of the vent pipe or conduit connected to a dryer to determine whether it is clogged, before laborious effort is undertaken to examine and repair the dryer.

SUMMARY OF THE INVENTION

The present invention is a dryer vent check strip for quick and easy checking of whether a vent pipe or conduit connected to a residential or commercial dryer is clogged, kinked or broken. It can also be used to check the dryer as well.

It is an object of the present invention to provide an inexpensive, portable and disposable device that can be used to quickly and easily check a residential or commercial dryer and/or the vent system of the dryer.

When a dryer functions normally, it heats air going into the dryer drum. This warm dry air picks up moisture from the clothes and blows it out the vent pipe or hose. The temperature inside the dryer may be approximately in the range of 120 to 170 degrees Fahrenheit (° F.). For example, the dryer temperature for cotton clothes may be approximately 155° F. and for permanent press 135° F. If the vent is unblock and permits hot moist air to be exhausted at the outside or distal end of the vent pipe or hose, then the dryer can function normally to dry the clothes inside. In this case the temperature at the distal end of the vent pipe or hose will be very close to that inside the dryer.

If the vent is blocked because of a kinked or broken vent or a build up of lint, the dryer can not move the moist air away from the drum and the dryer can not get the clothes dry. In this case the temperature at the distal end of the vent pipe or hose will be substantially lower than that inside the dryer.

The present invention provides a dryer vent check device in the form of a flexible thin strip that has a temperature sensitive area.

The temperature sensitive area of the present invention dryer vent check strip is pre-treated with a material such as a chemical ink that changes its color under a particular temperature.

When used, one vent check strip is placed inside the dryer and another vent check strip is placed at the outer or distal end of the dryer vent pipe or hose. As the dryer is turned on and allowed to operate for a while, if the dryer itself functions normally, the temperature sensitive area of the inside vent check strip will change to a known color to indicate that the temperature inside the dryer has reached to a certain degree, i.e., 140° F. Meanwhile, if the temperature sensitive area of the outside vent check strip changes to a similar color, it means that the temperature of the hot exhaust air is about the same as the temperate inside the dryer, indicating that the vent system is unclogged. However, if the dryer vent system is clogged, the temperature sensitive area of the outside vent check strip will not change to the similar color as the temperature of the exhaust air is much lower than that inside the dryer due to the clogging of the vent system. In this way, the user or technician can quickly identify the problem and perform the appropriate repair service.

Described generally, the present invention is a device for checking the condition of a vent pipe connected to a dryer and th dryer itself by checking temperature. The vent check device is a generally elongated thin strip made of a flexible material. It has a pre-treated temperature sensitive area that changes its color at a threshold temperature within a working temperature range of the dryer when the dryer functions normally. The vent check strip can be placed inside the vent pipe at a location adjacent to an outer end of the vent pipe. After the dryer is turned on to perform its normal drying function for a period of time until it reaches its working temperature range, the vent check strip can be retrieved for examination.

The present invention has many advantages. It provides a quick way to determine whether a dryer malfunction is caused by a clogged vent system. It is light weight, flexible, portable and inexpensive. It is also very easy to use.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
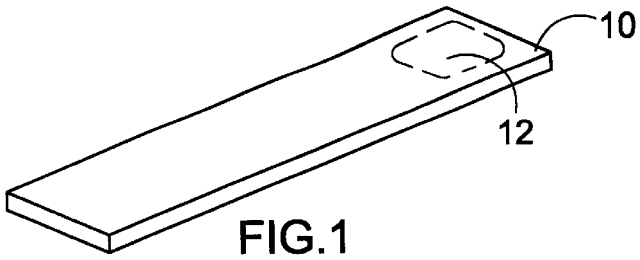
FIG. 1 a perspective view of the present invention dryer vent check strip.

Referring to FIG. 1, there is shown a preferred embodiment of the present invention dryer vent check strip 10. In this preferred embodiment, the vent check strip 10 is an elongated thin flexible and generally rectangular shaped piece made of paper, plastic, fabric or other suitable materials.

The vent check strip has a temperature sensitive area 12 at an end region of the vent check strip 10. The temperature sensitive area 12 is pre-treated with a temperature sensitive material. One example of such temperature sensitive material may be a chemical ink that appears in one color under certain temperature range but changes to another color under a different temperature range.

Figure 2:
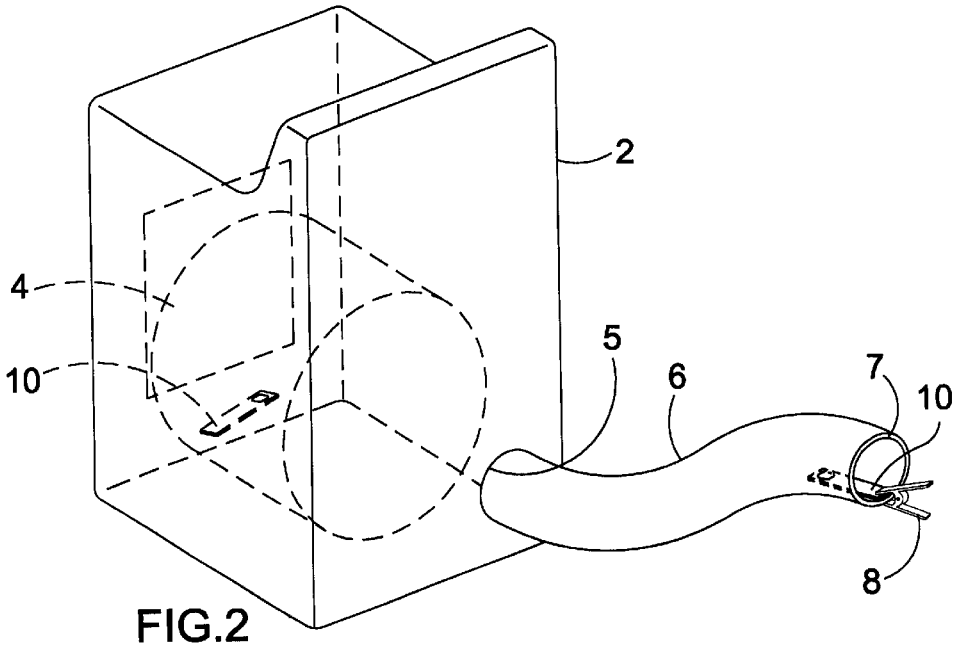
FIG. 2 is an illustrative diagram showing the present invention device is used to check the vent system of a dryer.
Figure 3:
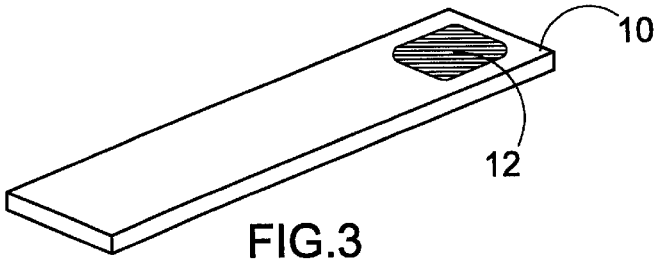
FIG. 3 is an illustrative diagram showing a temperature sensitive area of the present invention vent check strip changes color under certain high temperature.

Referring to FIG. 2, there is shown a dryer 2 having an internal heated drying chamber or drum 4 and a vent pipe or hose 6 for venting out the hot air and moisture from the dryer 2. The vent pipe or hose 6 has an inner or proximal end 5 which is connected to the dryer 2 and an outer or distal end 7 which extends to the outside of the house or structure in which the dryer 2 is located.

When dryer 2 works normally, hot air in the dryer drum 4 picks up moisture from the clothes and carries it out the vent pipe or hose 6. The temperature inside the drum 4 should be in the range of approximately 120 to 170° F., and the temperature of the hot air being blown out of the vent pipe or hose 6 should be close to the temperature inside the drum 4, i.e., in the same range of approximately 120 to 170° F.

Accordingly, the temperature sensitive area 12 of the vent check strip 10 is pre-treated with a temperature sensitive material that appears in one color when the temperature is below a pre-determined threshold temperature within the range of approximately 120 to 170° F., and that changes to another color when the temperature raises above the predetermined temperature. As an example, the predetermined threshold temperature may be 140° F.

A user or technician can use the dryer vent check strip 10 to quickly and easily check whether the vent pipe or hose 6 is clogged. As shown in FIG. 2, one vent check strip 10 is placed inside the drum 4 of the dryer 2, and another vent check strip 10' is placed in the vent pipe or hose 6 at a location adjacent to its outer or distal end 7. A clip 8 or similar device may be used to attached the vent strip 10' to the outer or distal end 7 of the vent pipe or hose 6 to prevent the vent strip 10' from being blown away by the hot air.

After the dryer 2 is turned on under the "time dry" about 10 to 15 minutes, the user can examine the vent check strip 10 placed inside the drum 4 of the dryer 2 and compare it with the vent check strip 10' placed at the outer end 7 of the vent pipe or hose 6. If they both change to a color corresponding to the higher temperature range of approximately 120 to 170° F., then the dryer 2 functions normally and its vent pipe or hose 6 is unclogged.

However, if the vent check strip 10 placed inside the drum 4 of the dryer 2 changes to the color that corresponding to the higher temperature range of approximately 120 to 170° F., but the other vent check strip 10' placed at the outer end 7 of the vent pipe or hose 6 does not change to that color, then it indicates that the dryer 2 functions normally and but its vent pipe or hose 6 is clogged.

Of course if the vent check strip 10 placed inside the drum 4 of the dryer 2 does not change to the color that corresponding to the higher temperature range of approximately 120 to 170° F., then the dryer 2 itself is not working normally and needs to be examined and repaired first.

The ink color used on the vent strip may be reversible, i.e., it returns to its original color after the temperature drops back to the normal (room) temperature. As a result, the vent strip may be used again for many times. This will further reduce the costs in service and maintenance of the dryer and vent system.

The present invention dryer vent check strip has many unique and advantageous features. It is small, flexible and inexpensive to manufacture. It is also very easy to use without complicated procedures. It provides a means to determine quickly whether a vent pipe or hose is clogged as a cause of dryer malfunction.

The vent check strip can be used for checking the dryer itself. When doing so, the vent pipe needs to be disconnected from the dryer. One strip is placed inside the drum of the dryer. The dryer is then turn to "time dry" setting for about 10 to 15 minutes and the color of the vent strip can be observed to see whether the dryer reaches the desired temperature.

Checking the vent and dryer separately will provide an opportunity to isolate the problem and provide a quick way to determine whether there is a problem in the dryer or in the vent system, which is particularly helpful when the end of the vent pipe is at a hard-to-reach location (such is on the roof of the house).

Defined in detail, the present invention is a device for checking a dryer which has a drum and a vent pipe with a proximal end connected to the drum for venting out hot air and moisture from the drum through a distal end of the vent pipe, comprising: (a) at least two vent checkstrips each being a generally elongated rectangular shaped thin piece made of a flexible material; and (b) each said vent check strip having a pre-treated temperature sensitive area that changes its color at a threshold temperature within a working temperature range of said dryer when said dryer functions normally; (c) whereby one of said at least two vent check strips can be placed inside said drum of said dryer and the other one of said at least two vent check strips can be placed inside said vent pipe of said dryer at a location adjacent to said distal end of said vent pipe, so that after said dryer is turned on to perform its normal drying function for a period of time until said drum reaches said working temperature range, said at least two vent check strips can be retrieved for comparison, such that if said one of at least two vent check strips placed in said drum changes its color but said other one of said at least two vent check strips placed in said vent pipe does not change its color, then it indicates that said vent pipe is clogged, kinked, broken or otherwise damaged and needs to be serviced.

Defined broadly, the present invention is a device for checking a dryer or a vent pipe with a proximal end connected to the dryer for venting out hot air and moisture from the dryer through a distal end of the vent pipe, comprising: (a) a vent check strip having a generally elongated thin configuration and made of a flexible material; and (b) said vent check strip having a pre-treated temperature sensitive area that changes its color at a threshold temperature within a working temperature range of said dryer when said dryer functions normally; (c) whereby said vent check strip can be placed inside said dryer or said vent pipe at a location adjacent to said distal end of said vent pipe, so that after said dryer is turned on to perform its normal drying function for a period of time until said dryer reaches said working temperature range, said vent check strip can be retrieved for examination, such that if said vent check strip does not change its color, then it indicates that said dryer is malfunction or said vent pipe is clogged, kinked, broken or otherwise damaged and needs to be serviced.

Defined more broadly, the present invention is a device for checking a dryer or a vent pipe connected to the dryer for venting out hot air and moisture, comprising a vent check strip which is temperature sensitive in that its color changes at a threshold temperature within a working temperature range of the dryer when the dryer functions normally, whereby the vent check strip can be placed inside the dryer or the vent pipe so that after the dryer is turned on to perform its normal drying function for a period of time until the dryer reaches the working temperature range, the vent check strip can be retrieved for examination, such that if the vent check strip does not change its color, then it indicates that the dryer is malfunction or the vent pipe is clogged, kinked, broken or otherwise damaged and needs to be serviced.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A device for checking a dryer which has a drum and a vent pipe with a proximal end connected to the drum for venting out hot air and moisture from the drum through a distal end of the vent pipe, comprising:

a. at least two vent check strips each being a generally elongated rectangular shaped thin piece made of a flexible material; and b. each said vent check strip having a pre-treated temperature sensitive area that changes its color at a threshold temperature within a working temperature range of said dryer when said dryer functions normally;

c. whereby one of said at least two vent check strips is placed inside said drum of said dryer and the other one of said at least two vent check strips is placed inside said vent pipe of said dryer at a location adjacent to said distal end of said vent pipe, and after said dryer is turned on to perform its normal drying function for a period of time until said drum reaches said working temperature range, said at least two vent check strips are retrieved for comparison, such that if said one of at least two vent check strips placed in said drum changes its color but said other one of said at least two vent check strips placed in said vent pipe does not change its color, then it indicates that said vent pipe is clogged, kinked, broken or otherwise damaged and needs to be serviced.

2. The device claimed in claim 1, wherein said flexible material is paper.

3. The device claimed in claim 1, wherein said flexible material is plastic.

4. The device claimed in claim 1, wherein said flexible material is fabric.

5. The device claimed in claim 1, wherein said temperature sensitive area of each said at least two vent check strips is pre-treated with chemical ink.

6. The device claimed in claim 1, wherein said working temperature range is approximately 120 to 170° F.

7. The device claimed in claim 1, wherein said threshold temperature is approximately 140° F.

* * * * *